United States Patent [19]

Hayashi

[11] 4,161,836

[45] Jul. 24, 1979

[54] BREECHBLOCK ASSEMBLY AND AN OPERATING MECHANISM FOR A FIRE-ARM AUTOMATIC LOADING

[75] Inventor: Hisao Hayashi, Tokyo, Japan

[73] Assignee: Kabushiki Kaisha Kawaguchiya Hayashi Juho Kayaku-ten, Tokyo, Japan

[21] Appl. No.: 851,736

[22] Filed: Nov. 15, 1977

[30] Foreign Application Priority Data

| | | | |
|---|---|---|---|
| Nov. 25, 1976 | [JP] | Japan | 51-141399 |
| Dec. 22, 1976 | [JP] | Japan | 51-154703 |
| Dec. 22, 1976 | [JP] | Japan | 51-172181[U] |

[51] Int. Cl.[2] ..... F41C 11/06

[52] U.S. Cl. ..... 42/16; 89/190

[58] Field of Search ..... 42/16; 89/190, 176

[56] References Cited

U.S. PATENT DOCUMENTS

| | | | |
|---|---|---|---|
| 2,418,946 | 4/1947 | Loomis | 42/16 |
| 2,570,772 | 10/1951 | Crittendon | 89/190 |
| 2,715,356 | 8/1955 | Fiorini | 42/16 |
| 2,863,246 | 12/1958 | Lee | 42/16 |
| 3,845,689 | 11/1974 | Zanoni | 89/190 |
| 3,866,344 | 2/1975 | Kawamura | 42/16 |

FOREIGN PATENT DOCUMENTS

| | | | |
|---|---|---|---|
| 466810 | 11/1951 | Italy | 42/16 |
| 684374 | 3/1965 | Italy | 42/16 |

*Primary Examiner*—Charles T. Jordan

*Attorney, Agent, or Firm*—Toren, McGeady and Stanger

[57] ABSTRACT

A breechblock assembly and operating mechanism for a gas operating automatic loading fire-arm has a breechblock slider adapted to be retracted by utilization of a gas pressure at the firing of the shotshell, a link is pivoted at the rear end of the slider so as to be swingable up and down and provided with swinging-movement limiting means, a breechblock is adapted to be locked so as to tightly close the breech face of the barrel and is mounted on the breechblock slider so as to be forwardly movable for a predetermined length, and a propelling force recoil spring mechanism engages the rear end of the link and is located in the stock of the gun for energizing the link to guide the tilting backward movement thereof, and the actuating mechanism is so constructed that it releases the limitation of the swinging-movement of the link when the breechblock slider and the breechblock are relatively moved by a predetermined length from their initial positions.

6 Claims, 13 Drawing Figures

BREECHBLOCK ASSEMBLY AND AN OPERATING MECHANISM FOR A FIRE-ARM AUTOMATIC LOADING

BACKGROUND OF THE INVENTION

The present invention relates to an improved breechblock assembly and an operating mechanism thereof for a gas operated automatic loading fire-arm.

Heretofore, a breechblock assembly incorporated in an automatic loading fire-arm of this type has been constituted by a breechblock effective to tightly close the breech face of the barrel of a gun, a backward movement regulating locking block of the aforementioned breechblock which disengageably engages the barrel and which tightly closes the said breech face when engaged with the barrel, and a breechblock slider attached to the breechblock so as to be movable forwardly and backwardly within a predetermined distance and moved backwardly when the gas pressure generated by the firing of a shotshell is transmitted thereto through a gas operated means so as to move the breechblock integrally therewith after releasing of the backward movement of the breechblock locked by the locking block as the breechblock moves in its backward stroke.

In other words, the general construction of the above described breechblock assembly is so constructed that, as shown in FIGS. 1 and 2, the breechblock slider (30) is mounted on the lower portion of the breechblock (29) so as to be forwardly and backwardly movable for a predetermined distance, and a radially directed throughhole (31) is formed at the central portion of the breechblock (29) so as to house therein the locking block (32) so that the projection (33) formed on the locking block (32) for engaging with the barrel of the gun (not shown) is swung upward and downward in response to the relative movement of the breechblock slider (30) with respect to the breechblock (29).

However, with such a construction as described above, the following problems listed below will act as hindrances. That is to say, in order to closely lock the breechblock (29) to the breech face of the barrel in relation to the projection (33) of the locking block to the barrel extension of the barrel, and since the operational force of the gas pressure generated by firing of the shotshell against the face of the breechblock (29) is regulated by the barrel through the aforementioned locking block (32), the forces $F_1$, $F_2$ indicated by the arrows in the drawing are given to the locking block (32) so as to generate a rotational movement due to the construction of the locking block (32), and the locking block (32) undergoes a clockwise rotation about the point A in the drawing resulting in collision of the rear end portion of the breechblock (32) opposite to the projection (33) against the inner wall of the barrel or the receiver, and, at the same time, the area of the collision of the locking block (32) against the front wall surface of the throughhole (31) of the breechblock (29) is located adjacent to the point A which is the above described center of rotation and becomes substantially linear so that the area of the pressure receiving surface of the above described force is small thereby requiring high rigidity and high strength of the breechblock (29) and the locking block (32).

Further, after releasing the locking of the locking block (32), the locking block (32) is made free in the throughhole (31) of the breechblock (29), so that it might leap freely during the forward and backward stroke of the breechblock assembly, therefore, it is conventional to provide necessary guide rails on the inner wall of the receiver to prevent malfunction of the locking block (32) caused by entanglement with the inner wall of the receiver or the like.

In case the rear end portion of the locking block (32) opposite to the side at which the projection (33) is provided is shifted to the breechblock (29), the pivot shaft portion is subjected to the above described rotational movement, therefore, it is necessary to increase the strength of that portion subjected to the rotational movement and to enhance the accuracy of the relative dimensions between the pivot shaft and the front wall surface of the throughhole (31) of the breechblock (29) as well as the locking block (32), thereby causing undesirable troubles in constructing the breechblock assembly.

The operating mechanism of the breechblock assembly (this terminology refers hereinafter to the breechblock, the breechblock slider and the locking block, etc. as a whole) is so constructed that the load due to the gas pressure at the firing of a shotshell is transmitted to the breechblock assembly in the receiver through a gas operated means mounted on the side of the barrel so that the breechblock assembly locked in a tightly closed relationship to the breech face is caused to recoil after a certain delayed timing of the action so as to discharge a used empty cartridge and then the breechblock assembly is forced to move forwardly by the force of the recoil spring housed in the gun-stock so as to be ready for charging a new shotshell and shooting of the same.

In a conventional construction of the breechblock assembly, a link is interposed between the above described breechblock assembly and the recoil spring which is pivoted to the breechblock slider of the breechblock assembly for the upward and downward swinging movement thereof. Since such a mechanism is so constructed that the breechblock assembly is provided with a breechblock adapted to be locked in a tightly closed manner to the breech face and a breechblock slider movable forwardly and backwardly within a predetermined distance with respect to the breechblock and coupled with the above described gas operated means, so that the breechblock slider is first moved backward at the firing of a shotshell so as to release the locking between the breechblock and the breech face thereby backwardly moving the breechblock integrally as a whole. Therefore, it is necessary to connect a link between the breechblock slider and the recoil spring in order to restore the breechblock assembly to its initial position by the resilient force of the recoil spring, and the configuration of the gun stock is in such a form that the shooter uses his shotgun with the breech thereof against his shoulder. Therefore, the link which is inclined to a certain degree with respect to the forward and backward movement of the breechblock assembly as is well known and is guided by the recoil spring housed in the gun stock must be made temporarily tiltable with respect to the breechblock assembly.

As described above, it is important that the breechblock assembly and, particularly, the breechblock are held in a locked state during the predetermined delay in the timing of the operation wherein the breech face is tightly closed. And it is the usual manner that the breechblock assembly is caused to be moved backward as a whole after the above described locking is released by the backward movement of the breechblock slider.

However, if the locking state of the breechblock is not appropriate, it is not unusual that malfunctions as such that the breechblock immediately moves backward, simultaneously with the firing of a shotshell, are caused. In such a case, since the shotshell is discharged from the barrel by the backward movement of the breechblock, the shotshell is sprung out of the barrel under the condition that the proper combustion of the gunpowder is being commenced, thereby resulting in a serious danger wherein the shooter is exposed to the ejection of the burning gas of the powder and injured.

SUMMARY OF THE INVENTION

The present invention provides an improved construction of a breechblock assembly which positively eliminates defects and disadvantages which have been confronted by the conventional breechblock assembly.

A first object of the present invention is to provide a construction of the breechblock assembly wherein the breechblock renders the locking block to be non-rotatable during the locking of the breechblock assembly, that is, during the time the breechblock tightly closes the breech face of the barrel so that the impact of the gas pressure acting against the breechblock by the shooting of a bullet is received by the engaging portions of the barrel and the locking block in the form of a projection and recess as well as by the breechblock slider. To this end, the breechblock is slidably embraced by the breechblock slider while the rear end portion of the locking block is radially fixedly supported by the breechblock slider. Thus, the locking block is limited in the rotational movement of the rear end portion thereof even at the time when the locking block is subjected to the above described impact load so that the collision thereof against the barrel or the inner wall of the receiver is completely prevented, thereby affording the advantages that it is not required to increase the thickness of the inner wall of the receiver for strengthening the same and to extend the barrel into the receiver.

A second object of the present invention is to provide a breechblock assembly wherein the pressure receiving surface of the locking block contacts the breechblock in the locked state of the above described breechblock assembly, so that the surface-to-surface contact is obtained between the pressure receiving surface and the breechblock. In the conventional construction of the breechblock assembly, the rotational movement of the rear end portion of the locking block at the time of receiving the pressure can hardly be avoided, so that the above described contact is usually effected in line-to-line manner. To the contrary, according to the present invention, since the rotational movement of the rear end portion of the locking block is limited, it is made possible to maintain surface-to-surface contact of the pressure receiving surface of the locking block with the breechblock at the time of locking thereof, thereby permitting the pressure per unit area of the pressure receiving surface to be greatly reduced while the rigidity and the strength of the locking block and the breechblock can be made lower.

A third object of the present invention is to provide a breechblock assembly wherein the projection of the locking block is forcibly housed in the throughhole of the breechblock after the engagement of the projection of the locking block with the recess of the barrel is released, so that the malfunction which might be caused due to the fact that the projection is caught by the inner wall of the receiver during the time the breechblock assembly is moving forward or backward, is positively prevented and the damage on the locking block is positively prevented because the projection is maintained in the throughhole. By the above construction of the breechblock assembly according to the present invention, it is unnecessary to provide any guide rail for the locking block in the inner wall of the receiver thereby affording remarkable advantages in the view point of the machining and manufacturing cost.

Further, the present invention aims at providing an improved operating mechanism comprising the breechblock assembly and the link which can avoid the occurrence of the defects and dangers described hereinbefore and liable to occur in the conventional actuating mechanism of the breechblock assembly. In the operating mechanism in accordance with the present invention, dangers to the shooter are positively avoided, even when a normal operation of the backward movement of the breechblock after the releasing of the locking of the breechblock following the backward movement of the breechblock slider is not assured by virtue of the construction that the backward movement of the breechblock assembly is restricted by means of the link within a predetermined length so that the ejection of the burning gas of the powder through the bullet discharge opening in the receiver is sharply decreased.

In accordance with the present invention, an improved breechblock lever is provided in the breechblock assembly thereby permitting the removal of the breechblock lever at the disassembly of the breechblock assembly for the inspection thereof to be carried out manually while, in addition, the reduction in number of the auxiliary parts of the breechblock assembly, and the simplicity of the assembling operation and lowering of the manufacturing cost are achieved, so that the assembling and disassembling operations can be readily carried out without the necessity of using special tools.

The above described breechblock lever is mounted on the breechblock assembly so that it can be manually operated separately from the mechanism for actuating the breechblock assembly utilizing the gas pressure or the reaction at the firing of a shotshell. In the conventional breechblock assembly, the breechblock lever has been so mounted on the assembly that the breechblock lever is inserted into the breechblock assembly housed in the receiver through the cartridge discharge opening forward in the side wall portion of the receiver (the cartridge discharge opening may be used for charging a shotshell) so as to be fitted in an opening formed in the breechblock assembly, and a pin is provided in the breechblock assembly in the area where the breechblock lever is fitted with the opening, which pin is adapted to be projected from the inner peripheral surface of the opening by the action of a spring so as to constitute means for preventing the withdrawal of the breechblock lever by virtue of the engagement of the pin with the recess formed in the breechblock lever.

However, by such a construction, if the engaging force of the pin with the recess is weak, the breechblock lever might be withdrawn from the breechblock assembly by the large impact force and the vibration and the like given to the breechblock assembly at the time of firing a shotshell, while, on the other hand, if the engaging force is made sufficiently large, it is made difficult to withdraw the breechblock lever at the time of disassembling the breechblock assembly for the inspection thereof, thereby causing difficulty in the spot operation of the gun.

In the spot operation of the breechblock assembly, it is often difficult to remove the breechblock lever from the breechblock assembly unless some appropriate tools are utilized, thereby resulting in shortcomings for the automatic guns which require frequent disassembling thereof for the inspection.

The improved breechblock mechanism which avoids the above described disadvantages confronted with by the conventional mechanism of the breechblock assembly is provided in accordance with the present invention on the basis of the view point that, when the breechblock assembly is moved forward and backward in the receiver with the breechblock lever mounted on the breechblock assembly, the breechblock lever following the movement of the breechblock assembly is moved forward and backward while the breechblock lever is held extending through the cartridge discharge opening and a guide hole provided contiguous to the cartridge discharge opening. Thus, the means for preventing the removal of the breechblock lever is provided in the wall surface of the receiver in accordance with the present invention. To this end, the breechblock lever is formed with leg portions which are adapted to slidably contact with the inner wall surfaces of the edge portions of the cartridge discharge opening and the guide hole under the condition that the stem portion of the breechblock lever is engageable with the opening of the breechblock assembly, and, further, a withdrawal groove is provided in the cartridge discharge opening at a predetermined position (prior to the assembling of the gunbarrel) which groove is adapted to enable the above described leg portions to be inserted therein. By such a construction, the pin and the spring and the like for preventing the withdrawal of the breechblock assembly as are required in the conventional breechblock assembly are dispensed with in accordance with the present invention, and it suffices to provide merely an opening in the breechblock assembly for fitting the stem portion of the breechblock lever therein, thereby affording remarkable advantages in reducing the number of auxiliary parts, simplifying the assembling operation and lowering the manufacturing cost of the breechblock assembly and the like. Further, in the disassembling operation of the breechblock assembly for the inspection thereof, no special tools are required and the manual removal of the parts are easily carried out.

The detailed description of the preferred embodiment of the present invention will be made hereinafter with reference to the accompanying drawings.

BRIEF DESCRIPTION OF THE DRAWINGS

FIG. 3 is an enlarged exploded perspective view illustrating the respective parts of the breechblock assembly, FIG. 4 is a fragmentary longitudinal sectional side view illustrating the mechanism of the automatic gun, FIG. 5 is a side view of FIG. 4, FIG. 6 is a longitudinal sectional side view showing the arrangement of the respective parts of the breechblock assembly at the state when the locking of the breechblock assembly is released, FIG. 7 is a longitudinal sectional view showing the arrangement of the respective parts of the breechblock assembly when the breechblock assembly is locked, and FIG. 8 is a sectional view along line A—A in FIG. 4.

DETAILED DESCRIPTION OF THE PREFERRED EMBODIMENT

Figure 1:
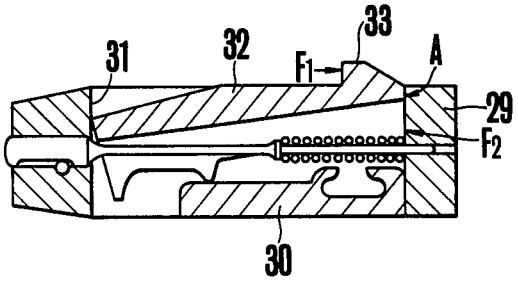
FIGS. 1 and 2 are longitudinal sectional views each showing an example of the breechblock assembly constructed in accordance with the prior art, FIG. 1 showing the state in which the breechblock assembly is locked, and FIG. 2 showing the released state of the breechblock assembly.
Figure 2:
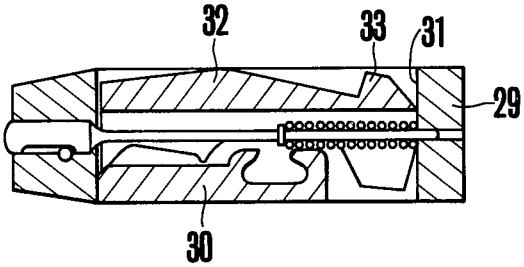

In FIGS. 3 to 8, the reference numeral (1) designates a breechblock in the form substantially of a stem or a trunk, (2) being a throughhole bored radially in the breechblock, (3) an ejector slot, (4) a locking block housed in the throughole (2) of the breechblock (1). A projection (5) is formed at the upper front end of the locking block (4) while a front leg portion (6) and a rear leg portion (7) are formed at the lower side of the locking block (4). An embracing portion (9) is provided at the front cylindrical portion (9') of the breechblock slider (8) for slidably housing therein the breechblock (1) so as to permit the same to be moved forward and backward over a predetermined length and for embracing and supporting the rear end portion of the locking block (4) so as to prevent the radial movement thereof. The embracing portion (9) is opened at the front end thereof while the transverse cross-section of the embracing portion (9) is generally C-shaped. An opening (10) for permitting the front leg portion (6) of the locking block (4) to be fitted therein and a lateral hole (11) for receiving the breechblock lever (12) are formed in the embracing portion (9) of the breechblock slider (8).

The reference numerals (13) and (14) represent axial holes formed at the center of each of the breechblock (1) and the breechblock slider (8); (15) designating the striker or firing pin inserted through and in closely fitting engagement with the axial holes (13) and (14), the striker being urged backward by means of a coil spring (16) located between a stepped portion of the striker (15) and the front inner wall surface of the breechblock (1) where the throughole (2) is formed, while the striker (15) is mounted on the breechblock slider (8) by means of a pin (17) so as to be movable axially within a predetermined length.

The mechanism thus so far described as being constituted by the parts listed above is referred to hereinafter in this specification as the breechblock assembly S.

Figure 8:
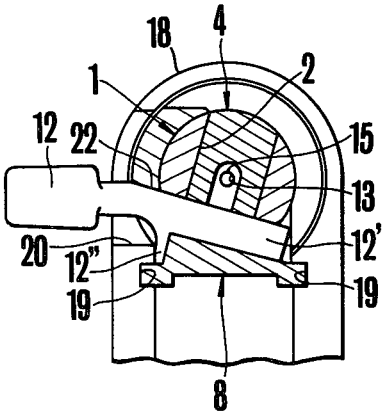

The reference numeral (18) designates the receiver, the receiver supports the breechblock assembly S movably forward and backward as shown in FIG. 8 by the engagement of a pair of recessed rails (19) formed in the inner wall of the receiver (18) with the breechblock slider (8).

Figure 4:
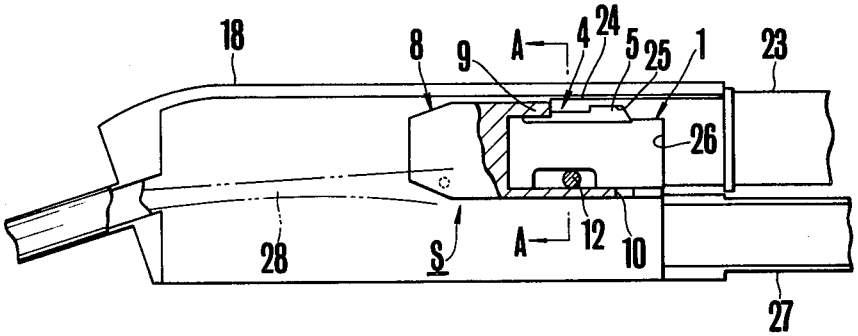
FIGS. 3 to 8 are views showing an embodiment of the breechblock assembly in accordance with the present invention.
Figure 3:
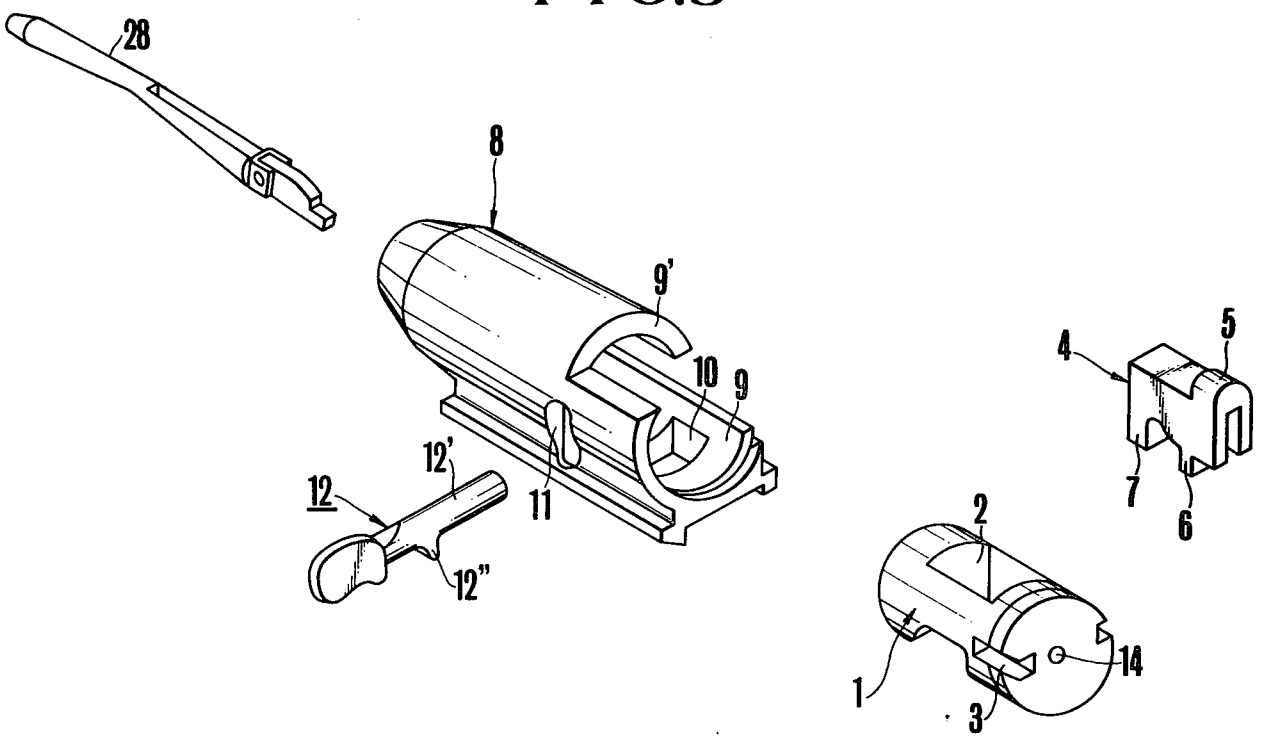
Figure 5:
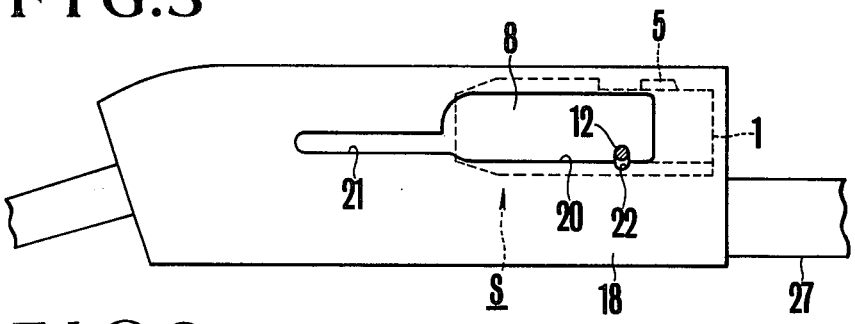

As shown in FIGS. 5 and 8, a discharge opening (20) for ejecting empty cartridges is formed in the side wall of the receiver (18) and a guide slot (21) is provided adjacent to the discharge opening (20) contiguous therewith for guiding the breechblock lever (12), and a withdrawal groove (22) for removing the stem portion (12') of the breechblock (12) is formed in the side wall of the discharge hole (20). A withdrawal-preventing leg portion (12'') is formed at an intermediate portion of the stem portion (12') of the breechblock lever (12) projecting therefrom. The reference numeral (23) designates the gunbarrel to which the receiver (18) is fixedly secured as shown in FIG. 4, a recessed portion (25) being formed in the extended portion (24) of the barrel (23) in which the projection (5) of the locking block (4) is engaged.

The reference numeral (26) designates the breech face, (27) the cartridge magazine, while the reference numeral (28) designates the link connected to the breechblock slider (8).

The operation of the breechblock assembly in accordance with the present invention will be described below.

Figure 6:
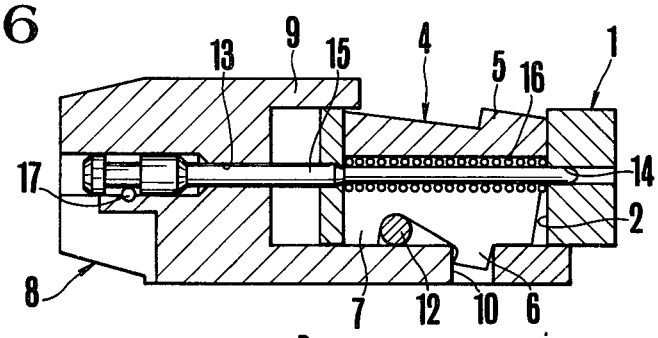
Figure 7:
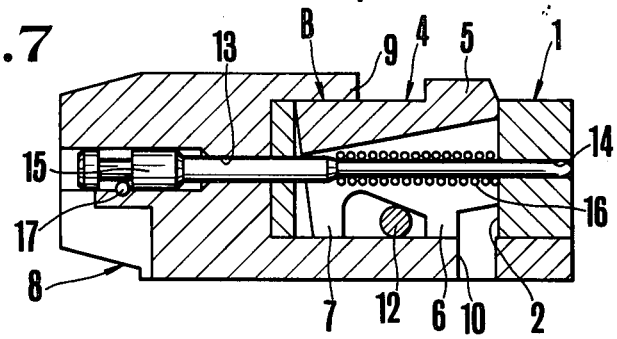

FIGS. 4, 7 and 8 show the positions of the respective parts of the breechblock assembly S at the locked condition thereof, and the locking block (4) is urged upward with its front leg portion (6) engaging with the breechblock slider (8) so that the projection (5) formed at the upper front end of the locking block (4) protrudes radially of the breechblock (1) so as to be engaged with the recess (25) formed in the extended portion (24) of the barrel (23). When a bullet is shot by the gun in the position of the respective parts of the breechblock assembly as described above, the impact force acting against the front surface of the breechblock (1) is received by the recess (25) provided in the extended portion (24) of the barrel (23) and the point B (refer to FIG. 7) of the breechblock slider (8) through the locking block (4), so that the breechblock (1) is arrested in its backward movement by the above described projection-recess engagement of the locking block (4) thereby making it impossible to move backward. At the same time, the impact force generated by the gas pressure is transmitted to the breechblock slider (8) through gas operated means (not shown), so that the breechblock slider (8) commences its backward movement. As the breechblock slider (8) moves backward by the predetermined distance, the front leg portion (6) of the locking block (4) falls into the radial hole (10) of the breechblock slider (8) so that the projection (5) of the locking block (4) is fitted into the radial through-hole (2) of the breechblock (1) (refer to FIGS. 6 and 7). By the construction of the embodiment thus far described, since the breechblock lever (12) urges the rear leg portion (7) of the locking block (4) as shown in FIG. 6 so as to forcibly cause the locking block (4) to swing, the locking block (4) is positioned so as to be held in the throughhole (2) of the breechblock (1) in the fitting relationship therewith as shown in FIG. 6. As a result, the locking of breechblock (1) and the gunbarrel (23) is released and the breechblock slider (8) moves backward accompanying the breechblock (1) so as to temporarily move the same backward. Therefore, the breechblock assembly S discharges the empty cartridge during the backward movement thereof and, thereafter, the breechblock assembly S moves again forward so as to be ready for the next firing of a shotshell.

The breechblock lever (12) engages with the breechblock slider (8) and serves to prevent the breechblock slider (8) and the breechblock (1) from rotating and, at the same time, it also serves as means for forcibly swinging the locking block (4) as described above.

In the above described construction, the locking block (4) is swung in the throughhole (2) of the breechblock (1) only at the front end side at which the projection (5) is formed while the rear end side of the locking block (4) is prevented in its radial movement. Further, during the time the breechblock assembly is held locked, the contacting surfaces of the front wall surfaces of the throughhole (2) of the breechblock (1) and the locking block (4) are in surface-to-surface contact against each other due to the fact that no rotational movement of the locking block (4) occurs. As a result, it is clearly seen that the surface pressure per unit area can be largely reduced. Further, since the locking block (4) is forcibly swung by the breechblock lever (12), the locking block (4) or the projection (5) thereof are positively prevented from projecting radially of the breechblock (1) during the time the span between the breechblock (1) and the breechblock slider (8) is extended, thereby positively eliminating the danger that the relating parts or the locking block (4) itself might be damaged. Therefore, by the construction as described above, no special parts or special machining are required for the configuration of the inner wall surface of the receiver (18) as shown in the drawing, thereby affording advantages in reducing the working processes and lowering the manufacturing cost.

Now a description will be given below how the breechblock lever (12) is fitted in the breechblock assembly S when the same is operated.

As previously described, the backward urging impact force is given to the breechblock slider (8) through the gas operated means (not shown) upon firing of a shotshell, and the stem portion (12') of the breechblock lever (12) collides against the rear leg portion (7) of the locking block (4) as the breechblock slider (8) moves backward, while, at the same time, the front leg portion (6) falls into the opening (10). Therefore, the locking block (4) is forcedly swung so as to disengage the projection (5) of the locking block (4) from the recess (25) of the extended portion of the gunbarrel thereby releasing the locking thereof.

In the above described operation, advantages are obtained in that the forced swinging movement of the locking block (4) is effected by the mounting of the breechblock lever (12) while the rotation of the stem-like breechblock (1) is prevented. The mounting of the breechblock lever (12) is effected in such a manner that, as shown in FIG. 5, the breechblock assembly S is inserted into the receiver (18) from the front end side thereof, and, thereafter, the leg portion (12'') of the breechblock lever (12) is inserted into the withdrawal groove (22) of the receiver (18) for removing the breechblock lever (12) with the opening (10) of the breechblock slider (8) being held in alignment with the withdrawal groove (22) while the stem portion (12') of the breechblock lever (12) is engaged in the hole of the breechblock slider (8). After the above procedures have been completed, the gunbarrel (23) is mounted on the receiver (18), thus the breechblock assembly S is moved backward to the position shown in FIG. 4, and then the breechblock lever (12) is prevented from moving forward to the position of the withdrawal groove (22) until the gunbarrel (23) is removed from the receiver (18). Therefore, as shown in FIG. 8, the leg portion (12'') of the breechblock lever (12) slidably contacts the inner wall of the edge portion of the empty cartridge discharge opening (20) of the receiver (18) thereby maintaining the condition under which the withdrawal preventing action is given to the breechblock lever (12).

In case the breechblock lever (12) is to be removed, the above described procedures are carried out in the reverse order, and the removal of the breechblock lever (12) is very simply effected at the position of the withdrawal groove (22) which is cut out from the inner wall arresting the removal of the breechblock lever (12).

Figure 9:
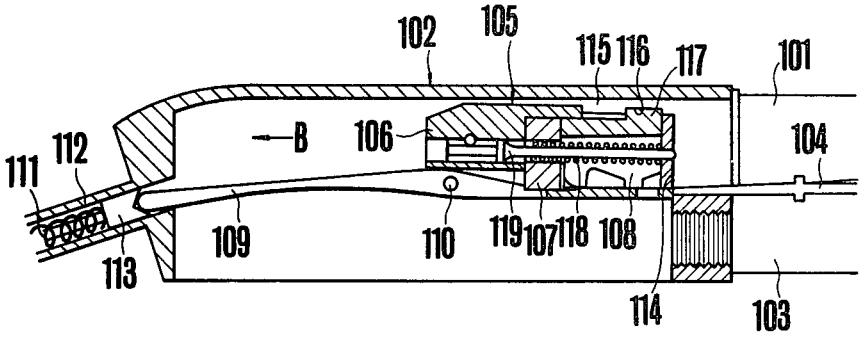
FIG. 9 is a longitudinal sectional side view showing the arrangement of the parts constituting the receiver portion prior to the firing of a shotshell.
Figure 10:
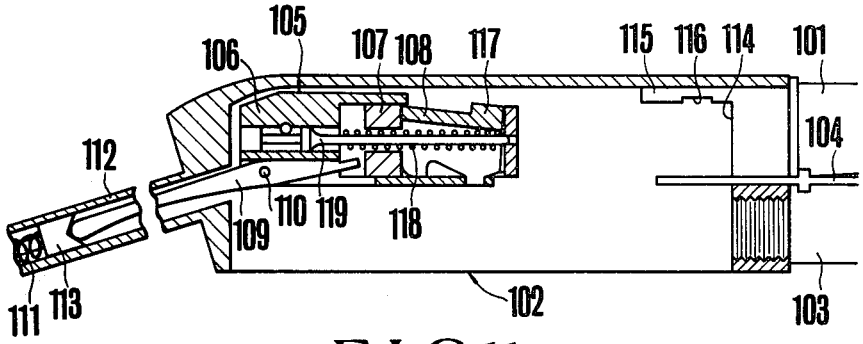
FIG. 10 is a longitudinal sectional side view showing the position of the breechblock assembly when it has moved backward after the shotshell has been fired, and FIGS. 11(*a*), 11(*b*) and 11(*c*) show the relationship between the breechblock assembly and the link, FIG. 11(*a*) is a side view, FIG. 11(*b*) is a bottom view, while FIG. 11(*c*) is an end view.
Figure 11A:
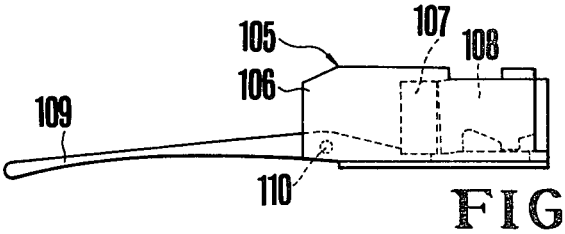
Figure 11B:
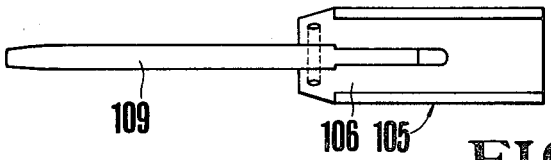
Figure 11C:
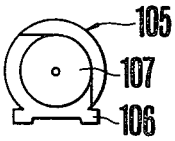

Now an improved operating mechanism for a breechblock assembly (105) and a link (109) will be described in detail with reference to FIGS. 9 to 11 illustrating the embodiment thereof.

In these figures, the reference numeral (101) designates a gunbarrel, (102) a receiver, (103) a cartridge magazine, (104) an operating bar of gas operated means, (105) a breechblock assembly, while the reference numeral (106) designates a breechblock slider which is guided by rails (not shown) provided in the inner wall of the receiver (102) so as to be movable forward and backward in the direction indicated by the arrow B in FIG. 9. The reference numeral (107) designates a breechblock which is housed in an opening formed in the breechblock slider (106) at the front end thereof and so mounted thereon as to be movable forwardly and backwardly over a predetermined length. The reference numeral (108) designates a locking block which is housed in a central opening of the breechblock (107) so as to be movable upwardly and downwardly. The locking block (108) is urged upwardly when the breechblock (107) and the breechblock slider (106) are at their non-displaced position (i.e. when they are held stationarily) as shown in FIG. 9, while it is lowered downward when the breechblock (107) and the breechblock slider (106) are moved relatively to each other. The reference numeral (109) designates a link which is pivoted to the breechblock slider (106) by means of a shaft (110) so as to be freely swingable while the tip of the link (109) engages with the lower portion of the rear end of the breechblock (107) so that the downward swinging movement of the rear end side of the link (109) can be restricted. However, the above described restricting effect is released when the breechblock (107) and the breechblock slider (106) are moved relatively to each other. The numeral (111) designates a recoil spring, (112) a housing cylinder for housing the recoil spring (111), (113) a link receiver interposed between the link (109) and the recoil spring (111). Further, the numeral (114) designates a breech face, (115) an extended portion of the gunbarrel (101), while the numeral (116) designates a locking recessed hole formed in the extended portion (115).

The operation of the above described operating mechanism will be described.

FIG. 9 shows the relative position of the respective elements constituting the mechanism prior to the firing of a shotshell (not shown), the resilient force of the recoil spring (111) being transmitted through the link (109) to the breechblock slider (106) so that the breechblock assembly (105) is positioned in its forwardly advanced position as shown. At this time, the front surface of the breechblock (107) engages with the breech face (114) so as to tightly close the same, while the breechblock slider (106) and the breechblock (107) are held in their non-displaced positions, thereby urging the locking block (108) upward so as to lock the breechblock (107) by the engagement of the projection (117) with the recessed hole (116) for the locking operation. The link (109) is engaged at its front end portion with the lower portion of the rear end of the breechblock (107) so that the downward swinging movement of the rear end side thereof is restricted.

At the shooting of a bullet, the gas pressure generated by the firing is transmitted to the breechblock slider (106) through the operating bar (104) of the gas operated means so as to serve as the backward urging force thereto. At the same time, the same gas pressure acts also against the front surface of the breechblock (107), but, since the breechblock (107) is locked by the locking block (108) as described above, it is prevented from being immediately moved backward.

NORMAL OPERATION

In the normal condition wherein the projection (117) of the locking block (108) engages with the recessed hole (116) in the extended portion (115) of the barrel (101), the breechblock (107) is held locked at the position shown in FIG. 9 and, therefore, the breechblock slider (106) commences at first the backward movement thereof and, there after, as the backward stroke thereof reaches a determined extent, upward urging action of the breechblock slider (106) onto the locking block (108) is released, so that the locking block (108) is lowered.

Thus, the arresting action onto the breechblock (107) is freed thereby commencing the backward movement of the breechblock (107) together with the breechblock slider (106). At the same time, the tip of the link (109) is disengaged from the lower portion of the rear end of the breechblock (107) by virtue of the relative movement between the breechblock (107) and the breechblock slider (106), thereby rendering the rear end portion of the link (109) to be freely swingable. Thus, the link (109) moves into the recoil spring housing cylinder (112) while it is being tilted a certain amount so as to assume the position shown in FIG. 10, and, thereafter, the breechblock assembly (105) commences its forward movement by the resilient force of the recoil spring (111) and restores its initial position with the next bullet being charged during its forward movement.

ABNORMAL OPERATION

In case the breechblock (107) is not properly locked against the extended portion (115) of the gunbarrel due to the failure or breakage of the projection (117) of the locking block (108) or improper upward urging action for the locking block (108), the breechblock (107) will commence immediately the backward movement simultaneously with the firing of a shotshell. Therefore, sufficient amount of the relative movement between the breechblock slider (106) and the breechblock (107) cannot be obtained, but they tend to be moved backward together with each other with the nondisplaced relationship between the breechblock slider (106) and the breechblock (106) being held substantially immovable, so that the restriction of the swinging movement of the rear end portion of the link (109) will not be released.

As a result, the link (109) is prevented from moving into the recoil spring housing cylinder (112) while it is being tilted, thereby limiting the backward movement thereof by means of the upper inner wall surfce of the recoil spring housing cylinder (112). Thus, the breechblock assembly (105) is arrested at a position backward of its stationarily held position by only a little stroke of its movement, so that the discharging of the bullet is hindered while the ejection of the burnt gas is remarkably lowered as compared with the conventional gun.

As described above, the operating mechanism for the breechblock assembly in accordance with the present invention positively protects the shooter from possible accident by the gun by preventing the bullet during the burning of the gunpowder from being discharged while ejection of the burning gas from the bullet discharging opening of the receiver is greatly decreased wherein the link having its rear end portion engaging with the recoil spring which is adapted to apply forward moving force to the breechblock assembly and its front end side pivoted to the breechblock slider for its free swinging movement is limited so as to render the same to be non-swingable when sufficient amount of the relative movement between the breechblock and the breechblock slider is not obtained, thereby restricting the backward movement of the breechblock assembly in the case the locking of the breechblock assembly is inoperative. Further, since the breechblock assembly will not effect normal backward and forward movements in case of the abnormal operation thereof, the charging of next bullet is positively prevented. From this point of view, the safety of the gun in accordance with the present invention is improved.

Further, in the breechblock assembly (105), since the striker spring (118) is arranged between the breechblock (107) and the breechblock slider (106) as shown in the drawings, the breechblock (107) and the breechblock slider (106) are advanced with the relative positions therebetween being shifted to each other in the advancing movement of the breechblock assembly (105) by virtue of the resilient action of the striker spring (118). Therefore, in this case, the upward movement of the locking block (108) is effected only when the breechblock slider (106) solely without accompanying the breechblock (107) after the breechblock (107) has engaged with the breech face (114) and has been stopped thereat. In other conditions of the breechblock (107), the projection of the locking block is held lowered into the breechblock so as to be housed therein, thereby positively preventing the projection from being damaged or broken by the collision thereof against the receiver or the extended portion of the gunbarrel.

Further, in the assembling operation, when the link is inserted into the receiver the link being rendered to be non-swingable, the rear end portion of the link is necessarily engaged in the position of the link receiver of the recoil spring, thereby affording advantages that the assembling operation is made easy.

In summary, the operating mechanism for the breechblock assembly constructed in accordance with the present invention provides remarkable improvements in the effectiveness as well as in the safety as compared with the conventional operating mechanism by virtue of the simple improvement in the link portion thereby affording extremely superior advantages.

What is claimed is:

1. In a breechblock assembly of an automatic gun the improvement comprises in combination a receiver, an axially extending gunbarrel fixed at one end to and extending axially from said receiver and having a breech face at the one end thereof, a breechblock slider having a substantially C-shaped or partly cylindrical embracing portion with its front end opened and housed in said receiver so as to be movable therein forwardly and backwardly, a substantially stem-shaped breechblock in slidable engagement with said embracing portion of said breechblock so as to be moved relatively to said breechblock slider by a predetermined distance in the axial direction thereof thereby permitting the breech face of said gunbarrel to be tightly closed, a locking block housed in a radial throughhole formed in said breechblock, said locking block having a projection formed in the upper portion of the front end of said locking block and said projection being engaged in a recess formed in an extended portion of the gunbarrel so as to restrict the backward movement of said breechblock and the rear end portion of said locking block being arrested by said embracing portion of said breechblock slider so as to prevent the withdrawal of said locking block, and means for swinging said locking block so as to protrude said projection of said locking block through said throughhole when the span between said breechblock and said breechblock slider is contracted while said projection is retracted into said throughhole when said span is extended.

2. A breechblock assembly according to claim 1, further comprising an engaging portion for forwardly and backwardly moving a breechblock lever fittingly secured to an opening of said breechblock slider so as to forcedly swing said locking block into said throughhole by said breechblock lever when the span between said breechblock slider and said breechblock is extended, said engaging portion being formed in said breechblock lever and said locking block, respectively.

3. A breechblock assembly according to claim 1, further comprising a breechblock lever engaged in said breechblock assembly so as to be detachable therefrom, said breechblock assembly being slidable in said receiver, said breechblock lever extending through an empty cartridge discharge opening in the side wall of said receiver and a guide hole so as to extend exterior to said receiver, said breechblock lever being provided with a withdrawal preventing leg portion slidably contacting the inner wall surface of said receiver at the edge portion of said empty cartridge discharge opening and at the edge portion of said guide hole, a withdrawal groove being provided in the front end portion of the side wall of said empty cartridge discharge opening of said receiver so as to permit said leg portion of said breechblock lever to pass through said withdrawal groove in the direction of the thickness of said side wall thereby permitting said breechblock assembly to advance to the breechblock lever detaching position only upon the removal of said gunbarrel from said receiver.

4. An operating mechanism of said breechblock assembly of an automatic gun according to claim 1, in which said breechblock assembly has said breechblock slider adapted to be backwardly moved by utilizing gas pressure at the firing of a shotshell and said breechblock adapted to be locked so as to tightly close said breech face and mounted so as to be moved together with said breechblock slider within a predetermined length forwardly and backwardly and a mechanism for backwardly moving said breechblock integrally with said breechblock slider by the backward movement of said breechblock slider after said locking has been released, said operating mechanism comprising a link pivoted to the rear portion of said breechblock slider so as to be freely swingable upwardly and downwardly and provided with swinging movement restricting means, and a recoil spring mechanism for energizing said link for the advancing movement thereof, said mechanism being arranged in the stock of said gun and engaging with the rear end portion of said link so as to guide the tilting and backward movement thereof, said restriction of the swinging movement of said link being released when the relative movement of said breechblock slider and said breechblock from the respective initial positions reaches a predetermined length.

5. In a breechblock assembly of an automatic gun the improvement comprises in combination a receiver, an axially extending gunbarrel fixed at one end to and extending axially from said receiver and having a breech face at the one end thereof, a breechblock slider having a substantially C-shaped or partly cylindrical embracing portion with its front end opened and housed in said recever so as to be freely movable therein forwardly and backwardly, a substantially stem-shaped breechblock in slidable engagement with said embracing portion of said breechblock slider so as to be movable relative to said breechblock slider by a predetermined distance in the axial direction thereof thereby permitting the breech face of said gunbarrel to be tightly closed, a locking block housed in a radial throughhole formed in said breechblock, said locking block having a projection formed in the upper portion of the front end of said locking block and said projection being engaged in a recess formed in an extended portion of the gunbarrel so as to restrict the backward movement of said breechblock and with the rear end of said locking block being arrested by said embracing portion of said breechblock slider so as to prevent the withdrawal of said locking block, means for swinging said locking block so as to protrude said projection of said locking block through said throughhole when the span between said breechblock and said breechblock slider is contracted while said projection is retracted into said throughhole when said span is extended, a breechblock lever inserted into a lateral hole formed in the embracing portion of said breechblock slider so as to be secured in position thereby, and said breechblock lever and said breechblock being loosely engaged so as to be movable a predetermined distance forwardly and backwardly so as to limit the rotation of said breechblock.

6. In a breechblock assembly of an automatic gun the improvement comprises in combination a receiver, an axially extending gunbarrel fixed at one end to and extending axially from said receiver and having a breech face at the one end thereof, a breechblock slider having a substantially C-shaped or partly cylindrical embracing portion with its front end opened and housed in a receiver so as to be movable therein forwardly and backwardly, a substantially stem-shaped breechblock in slidable engagement with said embracing portion of said breechblock slider so as to be movable relatively to said breechblock slider by a predetermined length in the axial direction thereof thereby permitting the breech face of said gunbarrel to be tightly closed, a locking block housed in a radial throughhole formed in said breechblock, said locking block having a projection formed in the upper portion of the front end of said locking block and said projection being engaged with a recess formed in an extended portion of said gunbarrel so as to restrict the backward movement of said breechblock while the rear end portion of said locking block is supported by said embracing portion of said breechblock slider so as to be non-displaceable in the axial direction, and means for swinging said locking block so as to protrude said projection of said locking block from said throughhole when the span between said breechblock and said breechblock slider is contracted thereby permitting the front end surface of said locking block to be brought into surface-to-surface contact with the inner wall of said throughhole of said breechblock while said projection is retracted into said through hole when said span is extended.

* * * * *